US011732936B2

(12) United States Patent
Kang et al.

(10) Patent No.: US 11,732,936 B2
(45) Date of Patent: Aug. 22, 2023

(54) CONDENSER AND TURBO CHILLER HAVING CONDENSER

(71) Applicant: LG ELECTRONICS INC., Seoul (KR)

(72) Inventors: Jungho Kang, Seoul (KR); Jinhee Jeong, Seoul (KR); Hyunwook Han, Seoul (KR); Uisik Hwang, Seoul (KR); Heewoong Lee, Seoul (KR); Chulmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/528,626

(22) Filed: Nov. 17, 2021

(65) Prior Publication Data

US 2022/0154982 A1 May 19, 2022

(30) Foreign Application Priority Data

Nov. 19, 2020 (KR) ..... 10-2020-0155554

(51) Int. Cl.
*F25B 39/04* (2006.01)
*F25B 1/00* (2006.01)

(52) U.S. Cl.
CPC ..... *F25B 39/04* (2013.01); *F25B 1/00* (2013.01)

(58) Field of Classification Search
CPC ..... F25B 39/04; F25B 1/00; F25B 43/043; F25B 2339/046; F25B 2339/047; F28D 7/163
See application file for complete search history.

(56) References Cited

U.S. PATENT DOCUMENTS

| | | | | |
|---|---|---|---|---|
| 10,247,457 | B2 | 4/2019 | Gu et al. | |
| 2015/0007604 | A1* | 1/2015 | Hu | F25B 49/025 165/158 |
| 2017/0254568 | A1* | 9/2017 | Miyoshi | F25B 1/10 |
| 2019/0041100 | A1* | 2/2019 | Miyoshi | F25B 43/04 |

* cited by examiner

*Primary Examiner* — Elizabeth J Martin
(74) *Attorney, Agent, or Firm* — KED & Associates LLP

(57) ABSTRACT

A condenser and a turbochiller including a condenser are provided. The turbochiller may include a compressor including an impeller that compresses refrigerant and a motor that drives the impeller; a condenser for heat exchange between the refrigerant introduced from the compressor and cooling water; an evaporator for heat exchange between the refrigerant discharged from the condenser and cold water; an expansion valve provided between the condenser and the evaporator; and a collector configured to collect noncondensable gas inside of the condenser. Accordingly, it is possible to efficiently collect noncondensable gas inside of a condenser of a turbochiller.

18 Claims, 6 Drawing Sheets

CONDENSER AND TURBO CHILLER HAVING CONDENSER

CROSS-REFERENCE TO RELATED APPLICATION(S)

This application claims priority under 35 U.S.C. § 119 to Korean Application No. 10-2020-0155554, filed in Korea on Nov. 19, 2020, whose entire disclosure(s) is/are hereby incorporated by reference.

BACKGROUND

1. Field

A turbochiller, and more particularly, a turbochiller capable of collecting noncondensable gas in a condenser are disclosed herein.

2. Background

In general, a turbochiller is an apparatus for performing heat exchange between cold water and cooling water using a refrigerant, and includes a compressor, an evaporator, a condenser, and an expansion valve. The compressor may include an impeller that is rotated by a drive force of a drive motor and a variable diffuser that converts kinetic energy of a fluid discharged by the rotation of the impeller into pressure energy.

Cooling water is introduced into and discharged from the condenser, and the cooling water is heated while passing through the condenser. Cold water is introduced into and discharged from the evaporator, and the cold water is cooled while passing through the evaporator. At this time, the cooled cold water is supplied to a cold water demanding destination.

In a conventional turbochiller, for example, U.S. Pat. No. 10,247,457 (hereinafter "Related Art Patent"), which is hereby incorporated by reference, discloses technology for collecting noncondensable gas and gas refrigerant from an upper portion of a condenser, condensing the gas refrigerant into liquid refrigerant in a purge device to be recirculated to an evaporator, and collecting only noncondensable gas and discharging it to the outside. However, such a conventional turbochiller collects noncondensable gas (including gas refrigerant) through a single port in an upper portion of the condenser, but the concentration of noncondensable gas is not uniform. Therefore, in the collection of the noncondensable gas through the single port in the upper portion of the condenser, a collection efficiency is inevitably reduced in terms of location and concentration. Due to this, there is a problem in that it takes a long time until a condenser leaving temperature difference (LTD) and a performance to normalize when the noncondensable gas is introduced.

In addition, the Related Art Patent discloses a chiller composed of a noncondensable gas inlet and outlet, a refrigerant inlet and outlet, and a purge tank, as a separate additional device, but only deals with the noncondensable gas collection and gas refrigerant condensation method in a purge device, and does not disclose a noncondensable gas collection location or method. The concentration of the noncondensable gas does not uniformly exist inside of a condenser shell, but if the noncondensable gas is collected without reviewing this, it is difficult to reach a desired performance.

BRIEF DESCRIPTION OF THE DRAWINGS

Embodiments will be described in detail with reference to the following drawings in which like reference numerals refer to like elements, and wherein.

DETAILED DESCRIPTION

Figure 1:
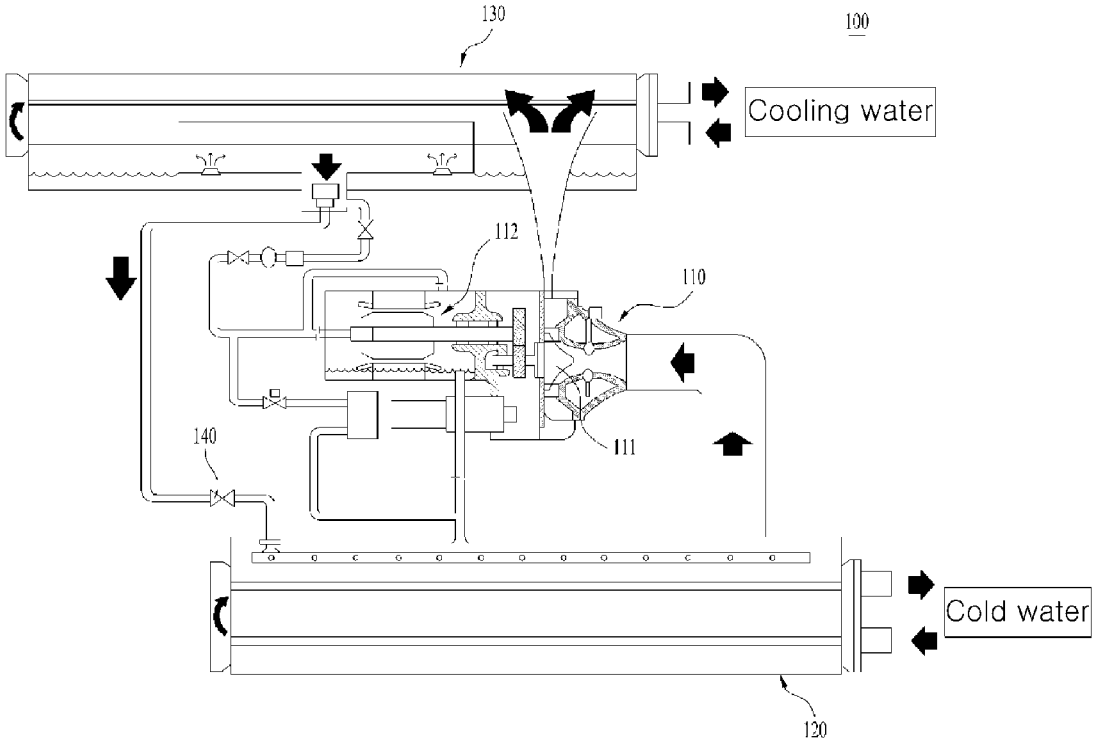
FIG. 1 is a schematic diagram illustrating an operating state of a turbochiller according to an embodiment.

Advantages and features of embodiments and methods of achieving them will become apparent with reference to the embodiments described below in conjunction with the accompanying drawings. However, embodiments are not limited to the embodiments disclosed below, but may be implemented in various different forms, and these embodiments are provided only to allow disclosure to be complete, and to completely inform those of ordinary skill in the art to which the embodiments belongs, the scope. Like reference numerals refer to like elements throughout.

The terms spatially relative, "below", "beneath", "lower", "above" and "upper" and the like can be used to easily describe the correlation of elements with other elements. Spatially relative terms should be understood in terms of the directions shown in the drawings, including the different directions of components at the time of use or operation. For example, when inverting an element shown in the drawings, an element described as "below" or "beneath" of another element may be placed "above" of another element. Thus, the exemplary term "below" may include both downward and upward directions. The elements may also be oriented in a different direction, so that spatially relative terms can be interpreted according to orientation.

The terminology used herein is for the purpose of illustrating embodiments and is not intended to restrict. In this specification, singular forms include plural forms unless the context clearly dictates otherwise. It is noted that the terms "comprises" and/or "comprising" used in the specification mean that mentioned elements, steps, and/or operations do not exclude the presence or addition of one or more of other elements, steps, and/or operations.

Unless defined otherwise, all terms (including technical and scientific terms) used herein may be used in a sense commonly understood by a person having ordinary skill in the art to which embodiments pertain. In addition, commonly used predefined terms are not ideally or excessively interpreted unless explicitly defined otherwise.

In the drawings, thicknesses and sizes of respective elements may be exaggerated, omitted, or schematically shown for convenience and clarity of explanation. In addition, a size and area of each element do not entirely reflect actual size or area.

Hereinafter, embodiments will be described with reference to the accompanying drawings.

FIG. 1 is a schematic diagram illustrating an operating state of a turbochiller according to an embodiment. Referring to FIG. 1, turbochiller 100 may include a compressor 110 that compresses a refrigerant, a condenser 130 that condenses the refrigerant, and an evaporator 120 that evaporates the refrigerant. The compressor 110 may include an impeller 111 that compresses the refrigerant. Further, the compressor 110 may include a motor 112 that drives the impeller 111, and one or more gears that transmits a drive force of the motor 112 to the impeller 111. Furthermore, the compressor 110 may include a variable diffuser that controls a flow rate of the refrigerant flowing into and discharged from the impeller 111. In addition, the compressor 110 may include an oil tank (no reference numeral) that stores a certain or predetermined amount of oil, and an oil pump (no reference numeral) that supplies oil to internal components, bearings and gears, for example, of the compressor 110 by pulling up oil from the oil tank. The compressor 110 may be a single compression unit or a plurality of compression units.

The evaporator 120 and the condenser 130 may have a shell in tube structure. Cold water and cooling water may flow into a tube (heat transfer tube), respectively, and the refrigerant may be accommodated inside of the shell. The shell may have a substantially cylindrical shape. More specifically, the evaporator 120 and the condenser 130 may have a cylindrical shape.

Cold water may be introduced into and discharged from the evaporator 120, heat exchange between the refrigerant and the cold water may be performed inside of the evaporator 120, and the cold water may be cooled while passing through the evaporator 120. Thereafter, the cooled cold water may be supplied to a cold water demanding destination.

Cooling water may be introduced into and discharged from the condenser 130, heat exchange between the refrigerant and the cooling water may be achieved inside of the condenser 130, and the cooling water may be heated while passing through the condenser 130. An expansion valve 140 may be provided between the condenser 130 and the evaporator 120. The refrigerant accommodated in the evaporator 120 and the condenser 130 may be maintained at a certain or predetermined required refrigerant level, for example, a flooded type, and such a refrigerant level may be adjusted through the expansion valve 140.

Figure 2:
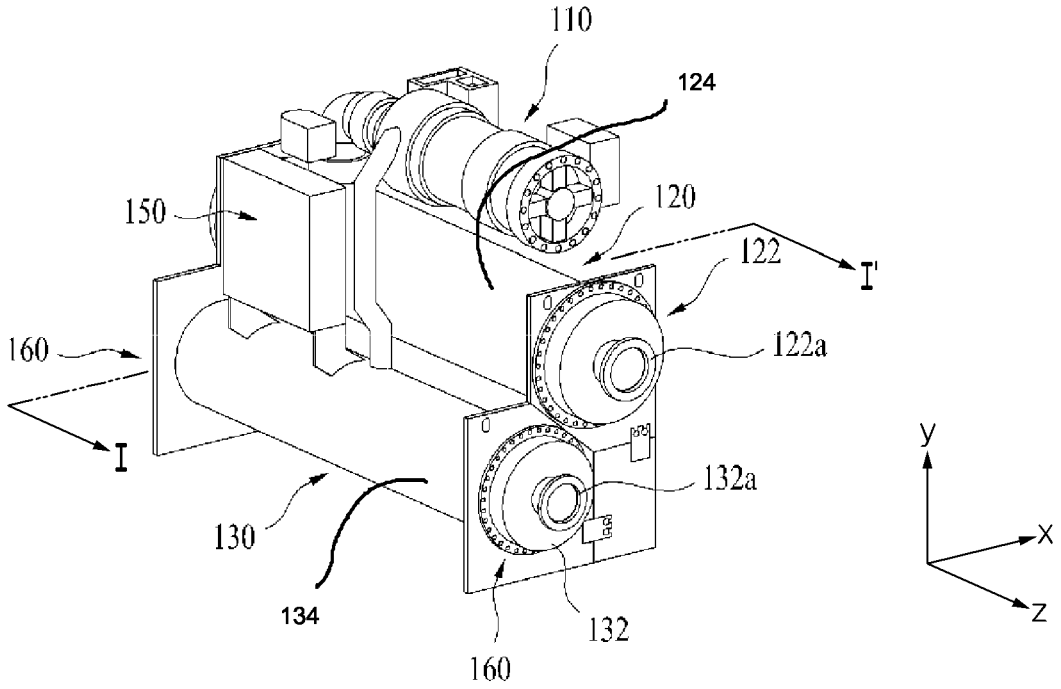
FIG. 2 is a perspective view of a main portion of a turbochiller according to an embodiment.
Figure 3:
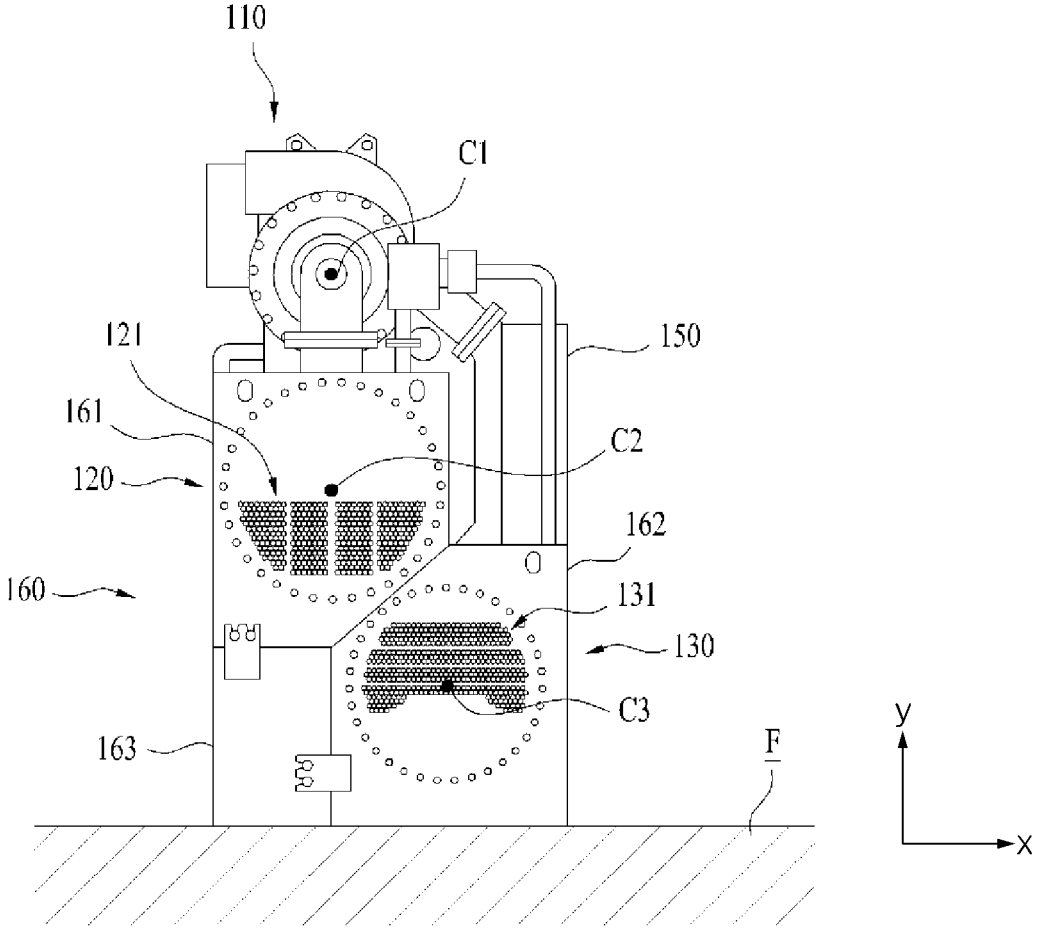
FIG. 3 is a front view of the turbochiller of FIG. 2.

FIG. 2 is a perspective view of a main portion of a turbochiller according to an embodiment. FIG. 3 is a front view of the turbochiller 100 of FIG. 2.

Referring to FIGS. 2 and 3, the turbochiller 100 may include the compressor 110, the condenser 120, the evaporator 130, and the expansion valve 140. The turbochiller 100 may be connected in various manners, for example, in series or in parallel, to configure a chiller system.

The compressor 110 may include the impeller 111 that compresses the refrigerant and the motor 112 that drives the impeller 111. Reference numeral C1 denotes a center of rotation of the impeller 111.

As described above, in the condenser 130, the refrigerant introduced from the compressor 110 exchanges heat with the cooling water. The condenser 130 may include a cylindrical shell 134 forming an outer shape and a cooling water tube array 131 provided inside of the shell 134. Cooling water may flow through the cooling water tube array 131, and heat may be exchanged with the refrigerant contained in the shell 134 during a flow process of the cooling water. Reference numeral C3 denotes a center (or central axis) of the condenser 130. For convenience of description, a flow direction of the cooling water or the cold water will be referred to as a lengthwise direction (Z direction) of the condenser 130 or the evaporator 120, respectively.

In the evaporator 120, heat exchange between the refrigerant discharged from the condenser 130 and the cold water is performed. The evaporator 120 may include a cylindrical shell 124 forming an outer shape and a cold water tube array 121 provided inside of the shell 124.

Cold water may flow through the cold water tube array 121, and heat may be exchanged with the refrigerant accommodated in the shell 124 during a flow process of the cooling water. Reference numeral C2 denotes a center (or central axis) of the evaporator 120.

The cold water tube array 121 may be provided in a lower area with respect to the center C2 of the evaporator 120. This is a design considering that the refrigerant flowing into the evaporator 120 includes a liquid state.

The compressor 110, the evaporator 120, and the condenser 130 may be respectively disposed in a state of being stacked along a certain or predetermined direction (y-axis direction, for example). The compressor 110, the evaporator 120, and the condenser 130 may be respectively disposed in a state of being stacked along the vertical direction (y-axis direction, for example) of an installation surface F of the turbochiller 100.

The evaporator 120 may be located between the compressor 110 and the condenser 130. More specifically, the turbochiller 100 has a structure in which the condenser 130, the evaporator 120, and the compressor 110 are sequentially stacked based on the installation surface F. This is to reduce a gap between the compressor 110 and the evaporator 120 so that the gas refrigerant in an upper portion of the evaporator 120 may be easily suctioned into the compressor 110. In addition, an installation area may be reduced by sequentially stacking the compressor 110, the evaporator 120, and the condenser 130.

The compressor 110 and the evaporator 120 may be disposed so that a rotational center C1 of the impeller 111 and a center C2 of the evaporator 120 are respectively located on a same axis. More specifically, referring to FIG. 2, the rotational center C1 of the impeller 111 and the center C2 of the evaporator 120 may be respectively located on arbitrary axes substantially parallel to the y-axis.

The condenser 130 and the evaporator 120 may be disposed so that the center C3 of the condenser 130 and the center C2 of the evaporator 120 are respectively located on a same axis. Alternatively, referring to FIG. 3, the condenser 130 and the evaporator 120 may be disposed so that the center C3 of the condenser 130 and the center C2 of the evaporator 120 are eccentric. Referring to FIG. 3, the center C3 of the condenser 130, the center C2 of the evaporator 120, and the rotational center C1 of the compressor may be spaced apart from each other by a certain or predetermined distance along an x-axis direction.

As described above, the evaporator 120 and the condenser 130 have a cylindrical shape, respectively. A volume of the evaporator 120 may be larger than a volume of the condenser 130. Even in this case, in order to reduce a gap between the compressor 110 and the evaporator 120, the evaporator 120 may be positioned between the compressor 110 and the condenser 130.

The turbochiller 100 may further include a control panel 150 that controls the compressor 110. Through the control panel 150, a function of inputting various control commands of the control panel 150 and displaying state information of the turbochiller 100 may be performed.

In this embodiment, a user may control operation of the compressor 110 through the control panel 150. In addition, the control panel 150 may display an inlet/outlet temperature of the cold water passing through the evaporator 120, an inlet/outlet temperature of the cooling water passing through the condenser 130, and a compressor temperature.

The control panel 150 and the evaporator 120 may be respectively located at an upper portion of the condenser 130. Various pipes, for example, a refrigerant pipe, configuring the turbochiller 100 may extend and be connected in a direction in which the control panel 150 is exposed. This is to facilitate service access when a chiller system is configured by combining a plurality of turbochillers.

A support member (support) 160 that respectively fixes the evaporator 120 and the condenser 130 may be included. The support member 160 may support and fix one end of the evaporator 120 and one end of the condenser 130, respectively.

The turbochiller 100 may further include at least two or more support members (supports) 160. In this case, a support member 160 may be provided at both ends of the evaporator 120 and the condenser 130.

The support member 160 may include a single plate capable of simultaneously supporting and fixing one end of the evaporator 120 and one end of the condenser 130, or a plurality of plates. The support member 160 may include a first plate 161 that fixes the evaporator 120 and a second plate 162 that fixes the condenser 130. A boundary between the first plate 161 and the second plate 162 may be formed as an inclined surface.

In addition, the support member 160 may include a third plate 163 connected to the first plate 161 and the second plate 162, respectively. The third plate 163 may perform a function of compensating a center of gravity of the support member 160. Each of the plates 161 to 163 may be assembled by, for example, welding and/or screw fastening.

Referring to FIGS. 2 and 3, a cap 122 may be provided at an end in the lengthwise direction of the evaporator 120. In addition, a flow hole 122*a* through which the cold water flows may be provided in the cap 122. Depending on the installation state, the flow hole 122*a* may serve as a cold water inlet or a cold water outlet.

In addition, a cap 132 may be provided at an end in the lengthwise direction of the condenser 130. In addition, a flow hole 132*a* through which the cooling water flows may be provided in the cap 132. Depending on the installation state, the flow hole 123*a* may serve as a cooling water inlet or a cooling water outlet.

A flow direction of the cold water flowing through the evaporator 120 and a flow direction of the cooling water flowing through the condenser 130 may be opposite to each other. That is, referring to FIGS. 2 and 3, when the flow hole 122*a* of the evaporator 120 is a cold water outlet, the flow hole 132*a* of the condenser 130 may be a cooling water inlet.

In this embodiment, the condenser 130 may have a collecting device (collector), formed therein, that collects noncondensable gas. Hereinafter, collecting device 136, 137 that collects the noncondensable gas in the condenser 130 will be described with reference to FIGS. 4 to 7.

In the case of a turbochiller to which a low-pressure refrigerant is applied, the evaporator 120 maintains an evaporation pressure lower than atmospheric pressure due to characteristics of the refrigerant. In addition, even when the turbochiller reaches a flat pressure in a stationary state, the pressure may become lower than the atmospheric pressure depending on an outside temperature, so that non-condensing gas, more specifically, external air and water vapor, flows into the chiller.

When the compressor 110 is operated in a state in which noncondensable gas is introduced, the gas refrigerant and the noncondensable gas, which are internal gases of the evaporator 120, are introduced into the condenser 130 through the compressor 110, and gas refrigerant is condensed to liquid refrigerant in the heat transfer tube 131 of the condenser 130. The condensed liquid refrigerant moves to the evaporator 120 to form a refrigeration cycle in which it is evaporated to gas refrigerant. Thus, the noncondensable gas evenly distributed in the chiller is collected in the condenser 130 simultaneously with operation of the turbochiller.

As a degree of noncondensable gas saturation, that is, a pressure increases, a condensation saturation pressure increases, and the compressor 110 has to work harder by that much. In addition, a concentration of the noncondensable gas increases around the heat transfer tube 131 of the condenser 130 condensing the gas refrigerant, and contact between the gas refrigerant and the condensing tube 131 is prevented, thereby reducing a condensing performance. Accordingly, if the high-concentration noncondensable gas around the condensing pipe 131 is quickly removed, a load on the compressor 110 may be reduced and the condensing performance improved.

Figure 5A:
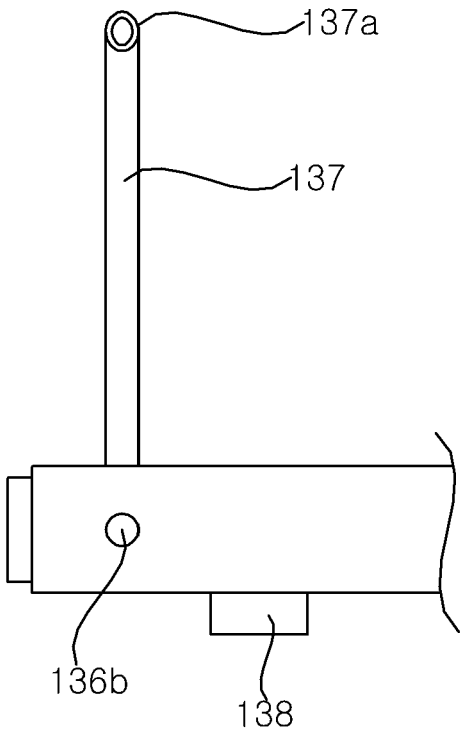
FIGS. 5A and 5B are diagrams as viewed from a bottom and a side of a collecting device inside of the condenser of the turbochiller according to an embodiment.
Figure 5B:
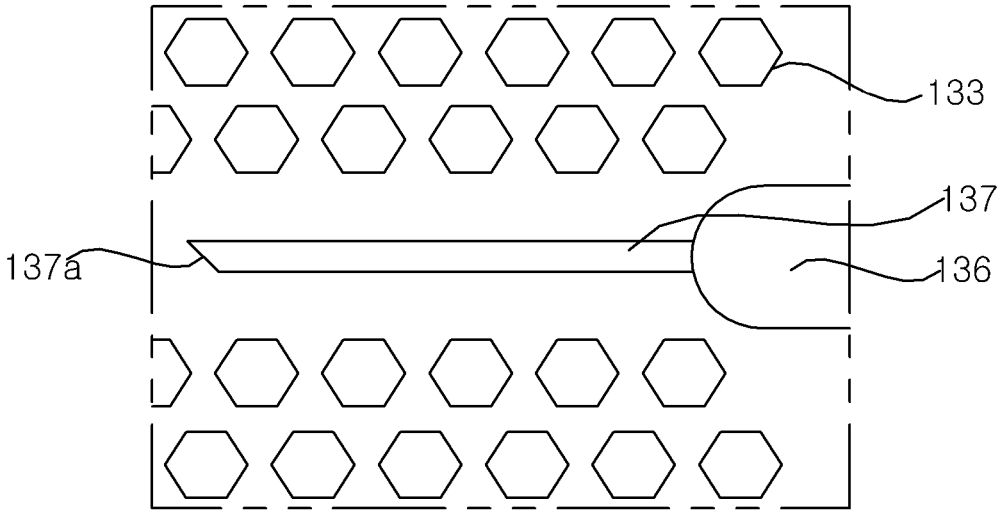
Figure 6:
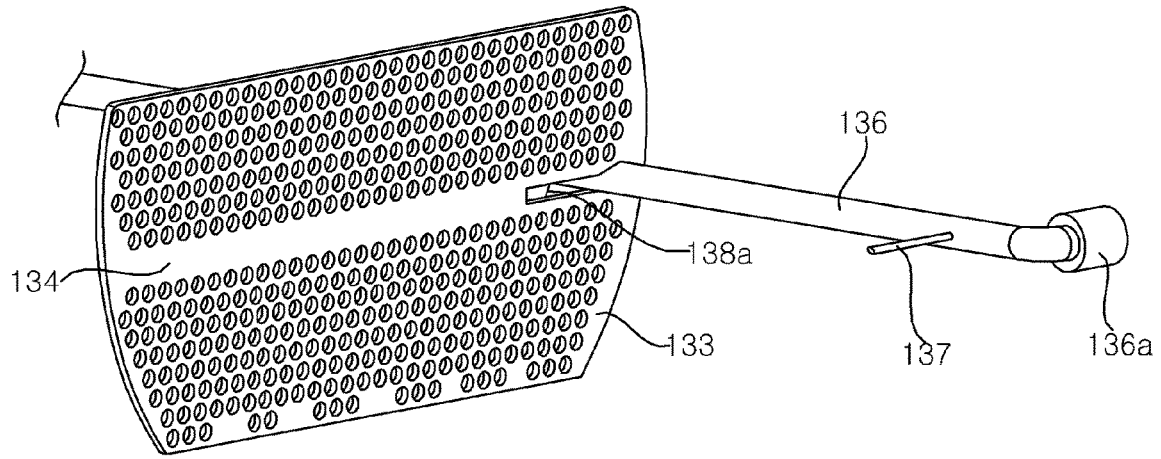
FIG. 6 is a perspective view illustrating a coupling structure of a collecting device and a draining plate according to an embodiment.
Figure 7:
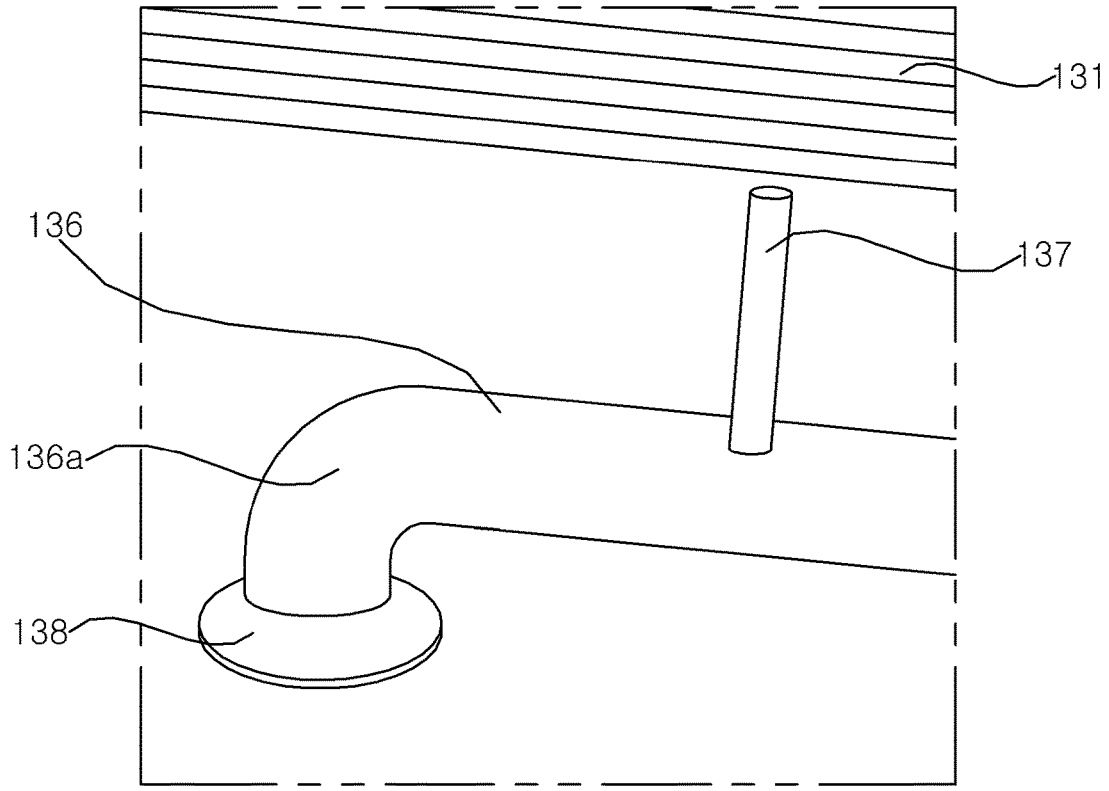
FIG. 7 is a photograph illustrating a collection device according to an embodiment.

The condenser 130 according to embodiments disclosed herein may include collecting device 136, 137 coupled thereto inside of the shell 134. More specifically, referring to FIGS. 4 and 6, FIG. 4 is a perspective view of the inside of a condenser shell cut by a XZ plane, FIGS. 5A and 5B are diagrams as viewed from a bottom and a side of a collecting device inside of the condenser of the turbochiller, FIG. 6 is a perspective view showing a coupling structure of the collecting device and the support member, and FIG. 7 is a photograph illustrating a collecting device according to an embodiment.

When the condenser 130 is a water-cooled condenser of a shell-tube type of the lengthwise direction (Z direction), it may include shell 134, heat transfer tube 131 installed in the lengthwise direction inside of the shell 134, and a support member (support) 138 that supports the heat transfer tube 131 in a state in which the heat transfer tube 131 passes through in order to prevent the heat transfer tube 131 from sagging.

Figure 4:
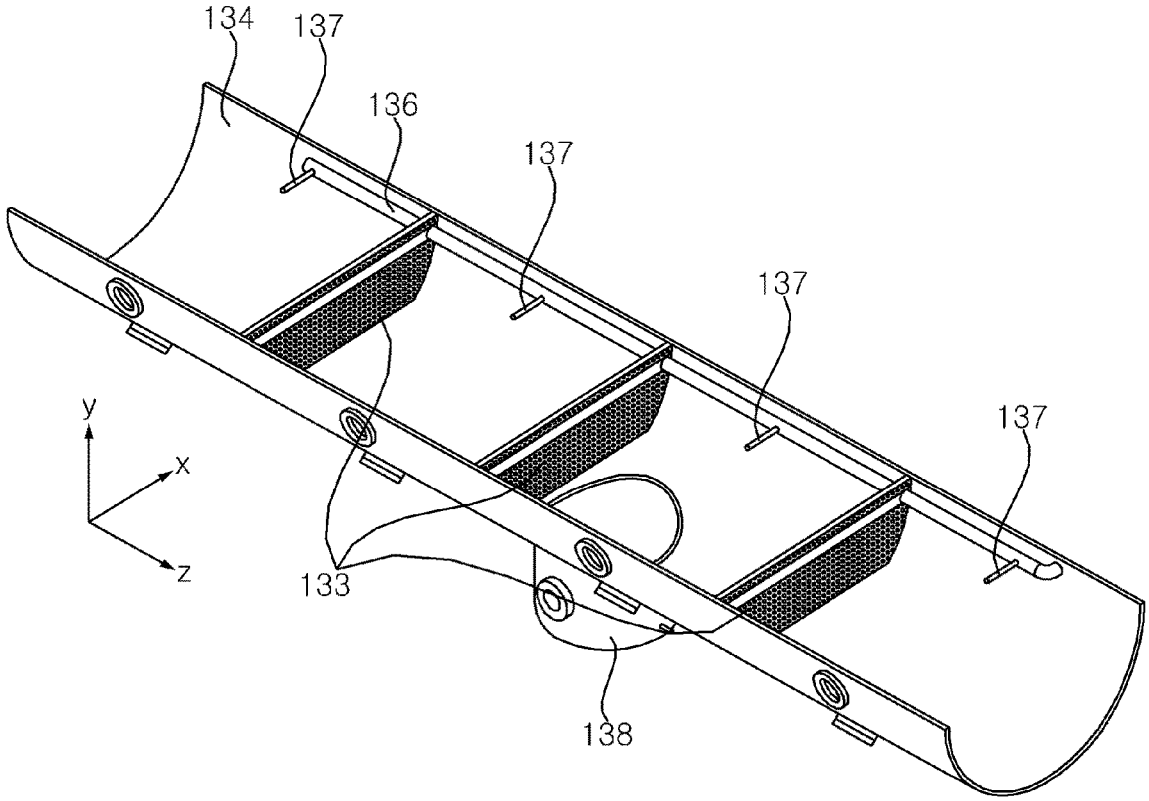
FIG. 4 is a cross-sectional perspective view of a condenser of the turbochiller of FIG. 2.

As shown in FIG. 4, the plurality of support members 138 fixedly installed on the inner surface of the shell 134 have a plurality of through-holes 133 through which the plurality of heat transfer tubes 131 pass. The plurality of support members 138 may be spaced apart from each other by a certain or predetermined distance, and formed perpendicular to the lengthwise direction (Z direction) of the shell 134, thereby simultaneously penetrating the plurality of heat transfer tubes 131 traversing the inside of the shell 134 in the lengthwise direction (Z direction).

In addition, the support member 138 may have a support area in which the through hole 133 is not formed in a center, and include an open portion 138*a* that supports moving pipe 136 of the collecting device 136 and 137 at an end of the support area. The open portion 138*a* may be open in a bar type; however, embodiments are not limited thereto. The open portion 138*a* may have a certain or predetermined width capable of fixing and supporting the moving pipe 136 passing through the open portion 138*a*, and various shapes may be implemented.

The collecting device 136 and 137 may include moving pipe 136 and collecting pipe 137. The moving pipe 136 may be disposed in the lengthwise direction (Z direction) along an inner sidewall of the shell 134 of the condenser 130. The moving pipe 136 may be connected to a plurality of the collecting pipe 137, and transfer the noncondensable gas collected from the plurality of collecting pipes 137 to an external purge device (not shown).

A plurality of the moving pipe 136 may be installed in a single shell 134, and may correspond to the support area of the support member 138. Alternatively, the plurality of moving pipes 136 may be formed in an upper portion of the shell 134 to correspond to the upper heat transfer tube 131 on the support area, or may be formed in a lower portion of the shell 134 to correspond to the lower heat transfer tube 131, or may be formed in both upper and lower portion sides of the shell 134. In addition, the moving pipe 136 may be formed at both sides of the support member 138.

A plurality of collecting pipes 137 may be formed in the X-axis direction to protrude toward the heat transfer tube 131 with respect to one moving pipe 136, and a number of the collecting pipes 137 may be set variously according to a length of the shell 134 and a length of the moving pipe 136.

More specifically, as shown in FIG. 4, the plurality of collecting pipes 137 may protrude toward the central axis C3 of the shell 134, and be spaced apart by a certain or predetermined distance. With respect to a single moving pipe 136, the collecting pipe 137 may be formed one by one at both ends of the moving pipe 136, and a plurality of collecting pipes 137 may be added between the collecting pipes 137 of both ends.

Referring to FIGS. 5A and 5B, the collecting pipe 137 may have a smaller diameter than the moving pipe 136 and protrudes by a certain or predetermined length. When one or a first end of the collecting pipe 137 is coupled to the moving pipe 136, the other or a second end is open toward the plurality of heat transfer tubes 131. The other end, which may be a free end, is cut so as to be inclined at a certain or predetermined angle, as shown in FIG. 5B.

Inclined surface 137*a* may be inclined inward from the upper portion to the lower portion, thereby preventing condensed liquid refrigerant falling from the upper portion from flowing into the collecting pipe 137. The angle of the inclined surface 137*a* may satisfy 15 degrees to 60 degrees, for example, 45 degrees. That is, when viewed from the bottom as shown in FIG. 5A, an internal flow path of the collecting pipe 137 may be open.

In addition, as shown in FIG. 5A, an opening 136*b* may be formed in or at both ends of the moving pipe 136 as a lower surface of a position at which the collecting pipe 137 is formed. The opening 136*b* of the moving pipe 136 may be formed so that liquid refrigerant introduced through the collecting pipe 137 may be discharged into the shell 134 of the condenser 130 by its own weight, the liquid refrigerant discharged back to the condenser 130, and only noncondensable gas may be transferred to the purge device through the moving pipe 136.

In this case, a diameter of the opening 136*b* may be the same as or larger than a diameter of a flow path of the collecting pipe 137. The opening 136*b* of the moving pipe 136 may be formed in both ends of the moving pipe 136, but may be formed only in an outlet end, not an inlet end. However, embodiments are not limited thereto. The inlet end and the outlet end of the moving pipe 136 may have a connection portion 136*a* so as to be connected to an external purge device.

The condenser 130 according to an embodiment may include the noncondensable gas collecting device 136, 137 disposed along the lengthwise direction, as shown in FIG. 7, inside of the shell 134, so that an inclined cross-section of the collecting pipe 137 of the noncondensable collecting device 136, 137 is exposed toward the plurality of condenser heat transfer tubes 131. Therefore, noncondensable gas having a high concentration may be easily collected on the surface of the heat transfer tube 131 of the condenser 130. Thus, collection efficiency may be improved by understanding dispersion characteristics of the noncondensable gas and disposing the collecting pipe 137 accordingly, and efficiency of the compressor 110 may also be improved.

As described above, it is possible to efficiently collect the noncondensable gas from inside of a condenser of a turbochiller. Further, it is possible to provide a method for fundamental removal by identifying the root cause that prevents contact of gas refrigerant with a condensation heat transfer tube, while a concentration of noncondensable gas is highest. Therefore, it is possible to improve collection efficiency of collecting the noncondensable gas inside of the condenser. In addition, it is possible to reduce an amount of discharged refrigerant during purging, by improving a noncondensable gas collection performance and collecting the noncondensing gas of high concentration using a device for collecting the noncondensable gas of high concentration around an axis of a heat transfer tube.

Embodiments disclosed herein provide a turbochiller capable of efficiently collecting noncondensable gas inside of a condenser of the turbochiller. Embodiments disclosed herein further provide a turbochiller capable of improving collection efficiency by specifying a collecting pipe for collecting noncondensable gas inside of a condenser and a collection port that protrudes from the collecting pipe. Embodiments disclosed herein furthermore provide a compressor capable of rapidly removing high-concentration noncondensable gas around a condensing pipe.

Embodiments disclosed herein provide a turbo chiller that collects noncondensable gas that may include a compressor comprising an impeller that compresses a refrigerant and a motor that drives the impeller; a condenser for heat exchange between the refrigerant introduced from the compressor and cooling water; an evaporator for heat exchange between the refrigerant discharged from the condenser and cold water; an expansion valve provided between the condenser and the evaporator; and a collecting device (collector) configured to collect noncondensable gas inside of the condenser. The condenser may be formed in a shell type, and the refrigerant may be condensed in a plurality of heat transfer tubes passing through the inside of the condenser.

The collecting device may include at least one moving pipe that passes through the inside of the condenser shell, and a plurality of collecting pipes that protrudes from the at least one moving pipe to collect the noncondensable gas around the heat transfer tube. A plurality of the heat transfer tubes may pass through in a lengthwise direction of the inside of the condenser shell. The moving pipe may be arranged in a same direction as the heat transfer tube inside of the condenser shell.

The collecting pipe may protrude from the at least one moving pipe toward a central axis of the condenser. The collecting pipe may be disposed in or at both ends of the at least one moving pipe.

The collecting pipe may be disposed to be spaced by a certain or predetermined distance between the both ends of the at least one moving pipe. One or a first end of the collecting pipe may be connected to the at least one moving pipe, and the other or a second end may be open toward the heat transfer tube.

The other end of the collecting pipe may have an inclined surface. The inclined surface of the collecting pipe may be inclined inward as it extends from an upper portion to a lower portion.

The at least one moving pipe may have an opening downwardly formed at a position at which the collecting pipe is formed so as to discharge liquid refrigerant collected through the collecting pipe. The opening of the at least one moving pipe may be formed in or at both ends of the at least one moving pipe. A diameter of the opening of the at least one moving pipe may be equal to or smaller than a diameter of flow path of the collecting pipe.

The condenser may include a plurality of support members (supports) which are formed perpendicular to a lengthwise direction of the condenser shell, have a through hole through which the plurality of heat transfer tubes passes, and support the plurality of heat transfer tubes. The support member may have a support area, in which the through hole is not formed, that is formed in a central portion, and has an open area, which is open for the at least one moving pipe to penetrate, that is formed in the support area. The support member may simultaneously support the plurality of heat transfer tubes and the at least one moving pipe.

Embodiments disclosed herein provide a condenser of a turbochiller, and the condenser may include a plurality of heat transfer tubes configured to perform heat exchange between refrigerant flowing in from a compressor that compresses the refrigerant of a turbochiller and cooling water; a shell tube configured to accommodate the heat transfer tube; a collecting device (collector) configured to be disposed in a same lengthwise direction as the plurality of heat transfer tubes in the shell tube and to collect noncondensable gas around the heat transfer tube; and at least one support member (support) configured to support the collecting device and the heat transfer tube simultaneously. The collecting device may include at least one moving pipe configured to pass through an inside of the shell tube, and a plurality of collecting pipes configured to protrude from each of the moving pipes and to collect the noncondensable gas around the heat transfer tube.

The collecting pipe may protrude from the at least one moving pipe toward a central axis of the condenser. The collecting pipe may have one end that is connected to the at least one moving pipe, the other or a second end that is open toward the heat transfer tube, and may be inclined inward as it extends from an upper portion to a lower portion.

While embodiments have been particularly shown and described with reference to exemplary embodiments thereof, it will be understood by those of ordinary skill in the art that various changes in form and detail may be made herein without departing from the spirit and scope as defined by the claims and such modifications and variations should not be understood individually from the technical idea or aspect.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A turbochiller, comprising:

a compressor comprising an impeller that compresses a refrigerant and a motor that drives the impeller;

a condenser for heat exchange between the refrigerant introduced from the compressor and cooling water;

an evaporator for heat exchange between the refrigerant discharged from the condenser and cold water;

an expansion valve provided between the condenser and the evaporator; and a collector configured to collect noncondensable gas inside of the condenser, wherein the collector comprises:

a plurality of collecting pipes configured to collect the noncondensable gas around a plurality of heat transfer tubes disposed within an inside of a shell of the condenser, and at least one condenser-collector pipe connected to the plurality of collecting pipes, and configured to transfer the noncondensable gas collected from the plurality of collecting pipes to an external purge device.

2. The turbochiller of claim 1, wherein the condenser is a shell condenser, and wherein the refrigerant is condensed in the plurality of heat transfer tubes that pass through the inside of the shell of the condenser.

3. The turbochiller of claim 2, wherein the plurality of the heat transfer tubes pass through in a lengthwise direction of the inside of the shell of the condenser, and wherein the at least one condenser-collector pipe extends in a same direction as the plurality of heat transfer tubes inside of the shell of the condenser.

4. The turbochiller of claim 3, wherein the plurality of collecting pipes protrudes from the at least one condenser-collector pipe toward a central axis of the condenser.

5. The turbochiller of claim 4, wherein one of the plurality of collecting pipes is disposed at each end of the at least one condenser-collector pipe, and wherein the plurality of collecting pipes is spaced by a predetermined distance between the ends of the at least one condenser-collector pipe.

6. The turbochiller of claim 5, wherein a first end of each of the plurality of collecting pipes is connected to the at least one condenser-collector pipe, and a second end is open toward the plurality of heat transfer tubes.

7. The turbochiller of claim 6, wherein the second end of each of the plurality of collecting pipes has an inclined surface.

8. The turbochiller of claim 7, wherein the inclined surface of the plurality of collecting pipes is inclined inward as it extends from a lower portion to an upper portion.

9. The turbochiller of claim 5, wherein the at least one condenser-collector pipe has at least one opening downwardly formed at a position at which the plurality of collecting pipes is formed so as to discharge liquid refrigerant collected through the plurality of collecting pipes.

10. The turbochiller of claim 9, wherein a diameter of the at least one opening of the at least one condenser-collector pipe is equal to or smaller than a diameter of a flow path of the plurality of collecting pipes.

11. The turbochiller of claim 10, wherein the condenser includes a plurality of supports which extend perpendicular to the lengthwise direction of the shell of the condenser, has a through hole through which the plurality of heat transfer tubes passes, and supports the plurality of heat transfer tubes.

12. The turbochiller of claim 11, wherein each support includes a support area, in which the through hole is not formed, formed in a central portion, and has an open area, which is open for the at least one condenser-collector pipe to penetrate therethrough, formed in the support area.

13. The turbochiller of claim 11, wherein each support simultaneously supports the plurality of heat transfer tubes and the at least one condenser-collector pipe.

14. A condenser, comprising:

a plurality of heat transfer tubes configured to perform heat exchange between refrigerant flowing in from a compressor that compresses the refrigerant of a turbochiller and cooling water;

a shell tube configured to accommodate the plurality of heat transfer tubes;

a collector configured to extend in a same lengthwise direction as the plurality of heat transfer tubes in the shell tube and to collect noncondensable gas around the plurality of heat transfer tubes; and at least one support configured to support the collector and the plurality of heat transfer tubes simultaneously, wherein the collector comprises:

a plurality of collecting pipes configured to collect the noncondensable gas around the plurality of heat transfer tubes, and at least one condenser-collector pipe connected to the plurality of collecting pipes, and configured to transfer the noncondensable gas collected from the plurality of collecting pipes to an external purge device.

15. The condenser of claim 14, wherein the plurality of collecting pipes protrudes from the at least one condenser-collector pipe toward a central axis of the condenser.

16. The condenser of claim 15, wherein a first end of each the plurality of collecting pipes is connected to the at least one condenser-collector pipe, and a second end is open toward the plurality of heat transfer tubes, and is inclined inward as it extends from a lower portion to an upper portion.

17. A turbochiller, comprising:

a compressor comprising an impeller that compresses a refrigerant and a motor that drives the impeller;

a condenser including a plurality of heat transfer tubes for heat exchange between the refrigerant introduced from the compressor and cooling water;

an evaporator for heat exchange between the refrigerant discharged from the condenser and cold water;

an expansion valve provided between the condenser and the evaporator; and a collector configured to collect noncondensable gas inside of the condenser, wherein the collector comprises:

at least one condenser-collector pipe that passes through an inside of a shell of the condenser; and a plurality of collecting pipes that protrudes from each of the at least one condenser-collector pipe to collect the noncondensable gas around the plurality of heat transfer tubes, wherein the plurality of the heat transfer tubes passes through in a lengthwise direction of the inside of the shell of the condenser, wherein the at least one condenser-collector pipe extends in a same direction as the plurality of heat transfer tubes inside of the shell of the condenser, wherein the plurality of collecting pipes protrudes from the at least one condenser-collector pipe toward a central axis of the condenser, and wherein the at least one condenser-collector pipe are connected to the plurality of collecting pipes, and configured to transfer the noncondensable gas collected from the plurality of collecting pipes to an external purge device.

18. The turbochiller of claim 17, wherein the plurality of collecting pipes is spaced by a predetermined distance between ends of the at least one condenser-collector pipe, and wherein a first end of each of the plurality of collecting pipes is connected to the at least one condenser-collector pipe, and a second end is open toward the plurality of heat transfer tubes.

* * * * *